United States Patent [19]

Bromberg

[11] 4,202,546

[45] May 13, 1980

[54] GAME

[75] Inventor: Howard M. Bromberg, Bronx, N.Y.

[73] Assignee: The Flexi Group, Inc., New York, N.Y.

[21] Appl. No.: 921,891

[22] Filed: Jul. 5, 1978

[51] Int. Cl.[2] ..... A63F 9/00

[52] U.S. Cl. ..... 273/93 R; 273/94

[58] Field of Search ..... 273/93 R, 88, 94

[56] References Cited

U.S. PATENT DOCUMENTS

| | | | |
|---|---|---|---|
| 890,890 | 6/1908 | Dapping | 273/93 R |
| 1,175,679 | 3/1916 | Barnhill | 273/93 R |
| 1,785,866 | 12/1930 | Huene | 273/93 R UX |
| 2,998,975 | 9/1961 | Koch | 273/93 R |
| 3,105,688 | 10/1963 | Gray | 273/93 R |
| 3,767,199 | 10/1973 | Board | 273/94 R X |
| 3,972,530 | 8/1976 | Dohn | 273/93 R X |

*Primary Examiner*—Paul E. Shapiro
*Attorney, Agent, or Firm*—Jack Posin

[57] ABSTRACT

The game includes at least one envelope, each envelope having a first face and a second face. Each face is provided with at least one window therein. Associated with at least one window on each face are sets of indicia. A slide is movably retained within each envelope and has printed thereon different sets of indicia. A player positions a marker on the slide which appears in a window in the first face of one envelope adjacent one of the indicia associated with the window which corresponds to a particular action or move in the game being played. This reveals in a window in the first face instructions to position a marker on the slide adjacent a particular indicium on the second face of the one envelope or a second envelope called for in the instruction. When the marker is so positioned the succeeding action is displayed in a window on the second face. In addition, instructions appear as to the position into which the marker on the first face is to be moved and the game continues accordingly.

16 Claims, 9 Drawing Figures

GAME

BACKGROUND OF THE INVENTION

1. Field of the Invention

The invention relates to games.

2. Prior Art

The popularity of games and particularly sport games such as baseball is ever increasing. The public desires to get involved with sports not only on a spectator level but on any and all levels including actual participation. Because of those individuals who for one reason or another cannot physically participate in the sport as well as for those individuals who actively participate in the sport and do not find their urge completely satisfied, the demand for such action games has increased considerably.

One type of action game, specifically a baseball game is the subject of U.S. Pat. No. 3,105,688 which consists of a game board capable of simulating an actual baseball game in variety and sequence of play and suspense having simple operative steps. This game relies to a considerable degree on chance.

Another board baseball game is described in U.S. Pat. No. 3,972,530 and is so designed that the skill and strategy of a player can be utilized to the unique interrelation of pitch selection by the pitcher, batter location in the batter's box and position of the fielders as well as placement of the ball on the playing field; thus providing a most true to life action baseball board game. In this game the action is controlled by the player.

Both of the games described in the patents mentioned above are of rather elaborate construction and the latter mentioned requires a certain degree of skill and understanding of the game for its complete enjoyment. Neither of these games is compact, can be enjoyed by relatively young children, and is of an exceptionally low manufacturing cost so that it can serve as a give-away premium item.

SUMMARY OF THE INVENTION

1. Purposes of the Invention

It is an object of the present invention to provide a game which is uncomplicated to use, relatively inexpensive to manufacture, and of simple construction.

Other objects of the present invention in part will be obvious and in part will become apparent as the description proceeds.

2. Brief Description of the Invention

Generally speaking, the above and other objects of the present invention are accomplished by a game including at least one envelope movably containing a slide. The envelope serves as a masking device and is provided with window means in its two faces. A first face is provided with a series of indicia associated with the window means. A player positions a marker printed on one side of the slide and appearing in the window means in the first face in one envelope adjacent one of the indicia associated with the window means. As the slide is so moved, a second set of indicia appears in the window means in the first face. The printed matter appearing in the window means may designate a particular action or move as well as provide information in the form of an instruction to position a marker on the second side of the slide adjacent the indicium appearing on the second face of the same or another envelope corresponding to the information appearing in the window means. Accordingly, another action or move appears in the window means in the second face to complete an action sequence. In addition, an instruction will be given as to where the marker is to be placed relative to the indicia on the first face.

In one embodiment the window means appearing in each of the first and second faces are essentially a longitudinally oriented window in which the marker appears and a horizontally oriented window in which the action, completion of action sequence and player instructions appear.

In a second embodiment, the marker may appear in longitudinally oriented windows; however the other indicia appearing in the first and second faces will appear in windows set out in various configurations. For instance if the game is a baseball game, the windows may be positioned at various locations about a baseball diamond.

In accordance with the present invention, the action in the game is initiated by a particular player positioning the marker adjacent an indicium on the first face of one envelope. The subsequent action to be taken in moving a marker with respect to the second face of the same or another envelope is controlled by the pre-selected information borne by the slide. In this manner, while the elements of skill and risk have been reduced, the excitement of the sport such as baseball is still available to younger children who may not understand or comprehend the intricacies of strategy or risk required in prior art devices.

The invention consists of the features of construction and arrangement of parts which will be detailed hereinafter and described in the appended claims.

BRIEF DESCRIPTION OF THE DRAWINGS

While the specification concludes with claims particularly pointing out and distinctly claiming the subject matter regarded as the invention herein, it is believed that the invention will be better understood from the following description when read in conjunction with the accompanying drawings, in which:

DESCRIPTION OF THE PREFERRED EMBODIMENT

While the present invention may have application in games of many sports as well as playing card games, sweepstakes and educational aids, the discussion which follows will deal with a baseball game for illustration only. It should be understood that the concept of the present invention is not to be restricted solely to a baseball game.

Figure 1:
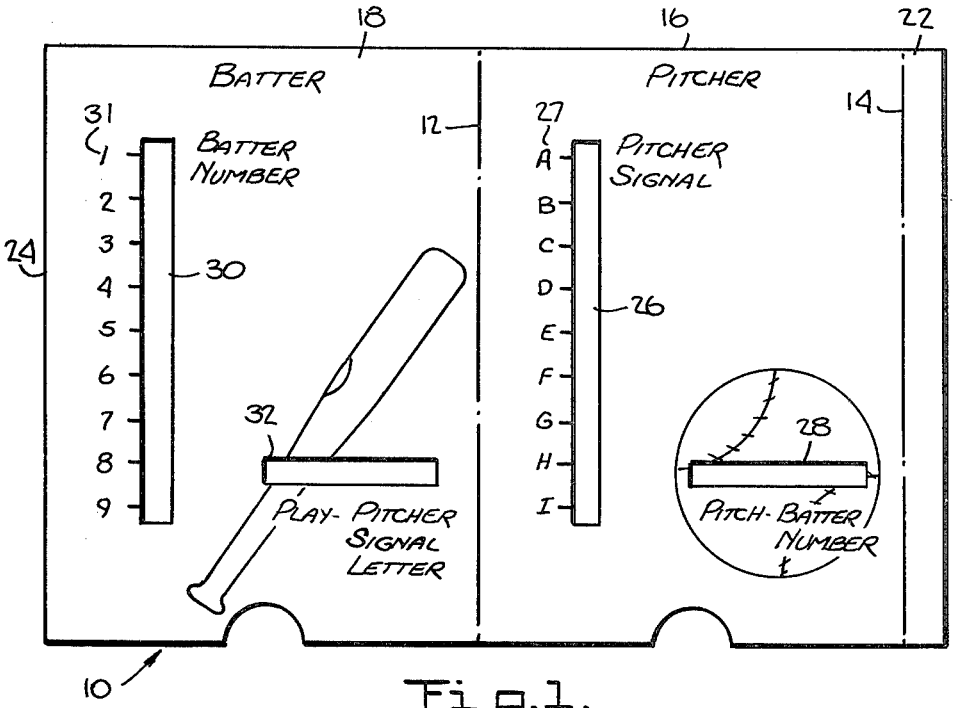
FIG. 1 is a view of the blank from which an envelope utilized in one embodiment of the present invention is formed.
Figure 5:
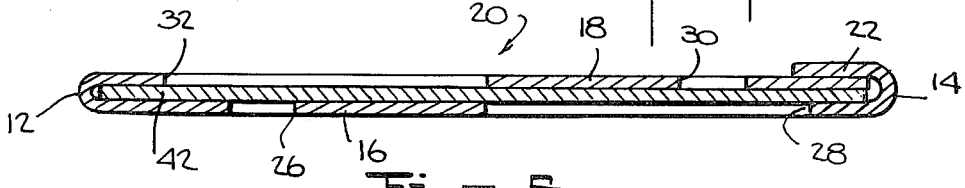
FIG. 5 is a partial sectional view taken substantially along the line 5—5 of FIG. 3.

Referring more particularly to the drawings, there is provided in FIG. 1, in accordance with one embodiment of the present invention, a blank 10 that is scored at lines 12 and 14. The scoring permits the blank 10 to be doubled on itself in such a manner that the first and second faces 16 and 18, respectively, form opposite sides of a sheath or envelope 20 with the flap 22 overlying the edge 24 of the second face 18 as can be seen best in FIG. 5.

The first face 16 is provided with window means. A first window means may be in the form of a longitudinally extending window 26 and has a set of indicia 27 associated therewith. The indicia may be letters of the alphabet. A second window 28 may also be provided and is oriented horizontally in the face. Similarly the second face 18 may be provided with a longitudinally extending window 30 having a set of indicia 31 associated therewith, which indicia may be numbers, as well as a second horizontal window 32.

A second blank 34 is divided by a score line 36 into a first side 38 and a second side 40. The sides 38 and 40 are folded about the score line 36 to form a support means or slide which is movably received with the envelope 20.

The blanks 10 and 34 may be of any lightweight flexible or semi-rigid material, for example, plastic, paper or paperboard. Consequently, the game in accordance with the present invention is a low cost item and can be used as a premium or give-away item.

Figure 2:
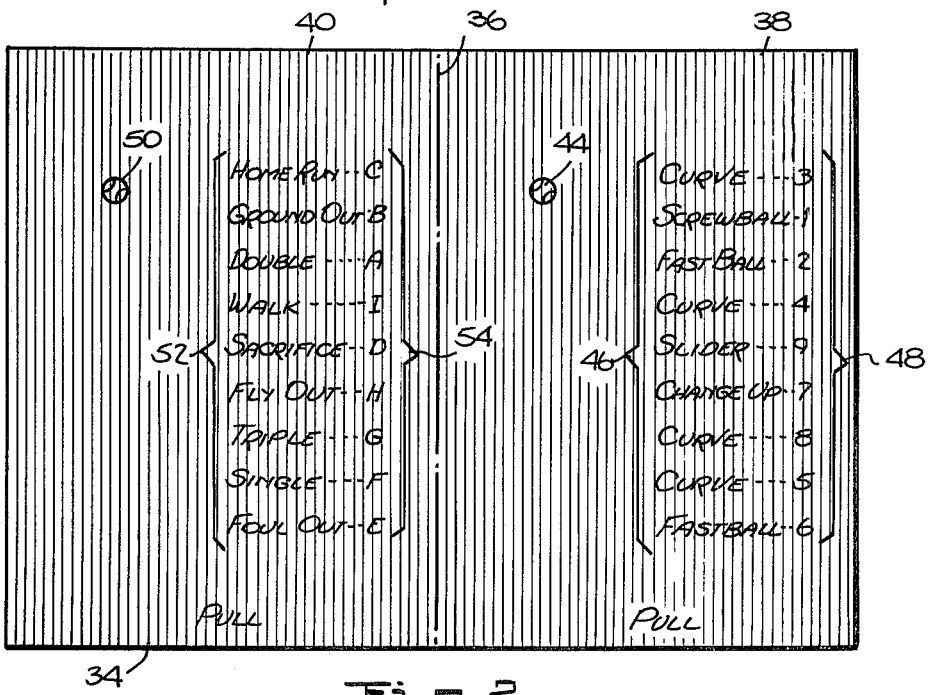
FIG. 2 is a similar view of a blank from which a slide that can be combined with the blank illustrated in FIG. 1 is formed.

With continued reference to FIG. 2, the first side 38 has printed thereon a first marking means 44 which may appear as a representation of a baseball as shown. Also printed on the first side 38 is a series of indicia denoting particular actions, e.g., pitches identified generally by the reference numeral 46. Associated with the series of indicia 46 and identified generally by the reference numeral 48 is a series of numbers the purpose of which will be apparent as the description proceeds. As can be seen in FIG. 2, for each pitch listed in the series 46, there is a corresponding number in the series 48. Each of the numbers set out in the series of indicia 31 on the second face 18 is represented at least once in the series 48.

Similarly, on the second side 40 there is printed a marker means 50 which may likewise be a representation of a baseball. Associated therewith is a series of indicia 52. In the series 52 are several possible actions or plays for any particular pitch made during a baseball game which together with series 46 completes an action sequence. Associated with the indicia in series 52 is a series of letters identified generally by the reference numberal 54 and each letter included in the series of indicia 27 on the first face 16 appears at least once in the series 54.

As noted hereinabove the blank 10 can be folded along the score lines 12 and 14 to form the envelope 20 and the blank 34 can be folded along the score line 36 to form a slide 42 which is movably retained within the envelope 20. The slide is positioned in the envelope with the first side 38 lying immediately behind the first face 16.

Figure 3:
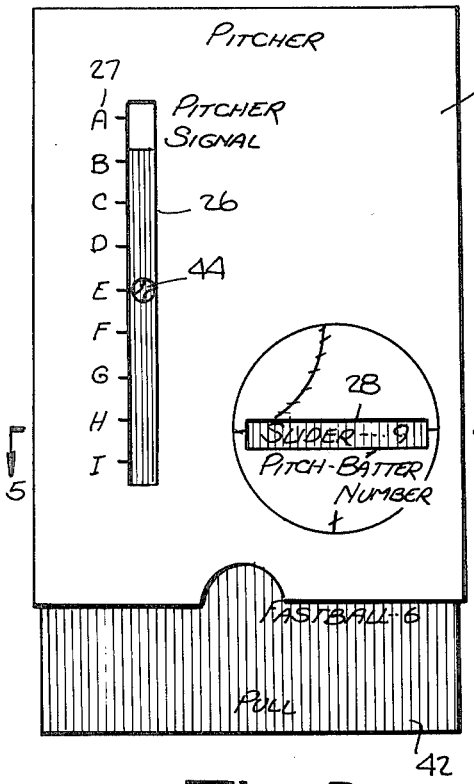
FIG. 3 is an assembled view of the blank of FIG. 1 and the slide of FIG. 2 showing the face on which the pitcher's selection is made.
Figure 4:
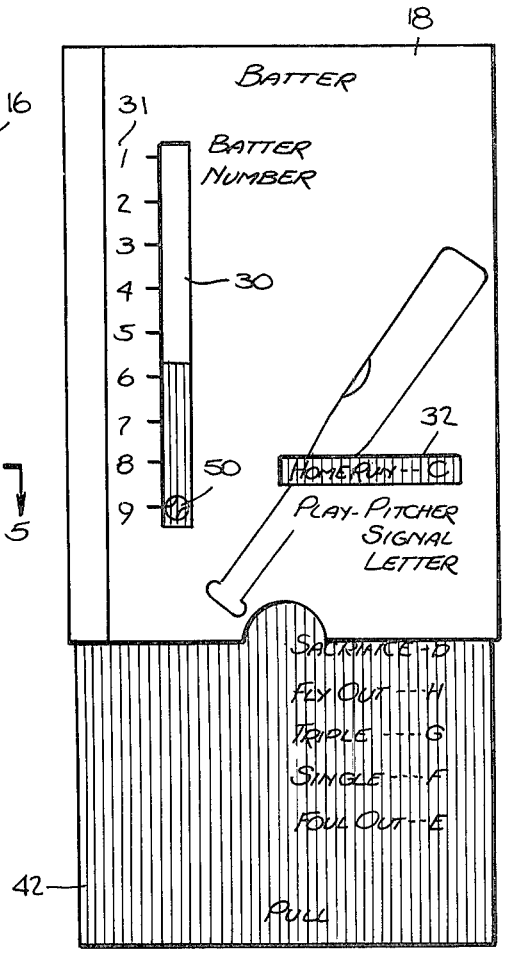
FIG. 4 is a view of the device illustrated in FIG. 3 from its reverse on batter's face.

The handling and use of the game is simple to understand. The pitcher herein referred to as "first player" moves the slide 42 to place the marker means 44 which appears in the window 26 adjacent a particular letter in the set of indicia 27. The particular letter to which the marker means 44 is moved is within the discretion of the first player. By way of illustration, as shown in FIG. 3 the marker means 44 has been positioned adjacent the letter "E". This results in the appearance in window 28 of a particular pitch and number listed in the series 46 and 48 respectively, i.e., "slider" as well as the number "9". The "second player" or batter, who may be the same as the first player, i.e. an individual playing alone or different individual, following the instruction appearing in the window 28, positions the marker means 50 appearing in the window 30 in the second face 18 adjacent the number "9" in the series of indicia 31 resulting in one of the possible plays in the series 52 and a letter in the series 54 appearing in the window 32. As can be seen in FIG. 4, the play is a "home run" and the letter is the letter "C". The second player then credits himself with one run and the game is returned to the first player who must move the slider 42 until the marker 44 is positioned adjacent the letter "C". This will result in another pitch and its associated number appearing in the window 28. The number so appearing serves as an instruction to the second player to position the marker 50 adjacent the window 30. Play continues until the second player has incurred three outs at which time the players switch positions. Preferably the indicia are set in such a predetermined pattern that three outs occur in the course of each game and, depending on the initial selection made in indicia 31, the number of runs scored will be different.

In addition to the sets of indicia appearing adjacent the windows 26 and 30, additional printed matter may appear on the first and second faces 16 and 18 respectively. By way of example, with reference to FIG. 1, the phrase "Pitcher's Signal" may appear adjacent the set of indicia 27, and the phrase "Batter's Number" may appear adjacent the set of indicia 31. Moreover, the windows 28 and 32 may also have legends and representations associated therewith as shown. Obviously, other phrases, legends and representations may be associated with the windows to add further baseball flavor to the game without detracting from the spirit of the present invention.

Figure 6:
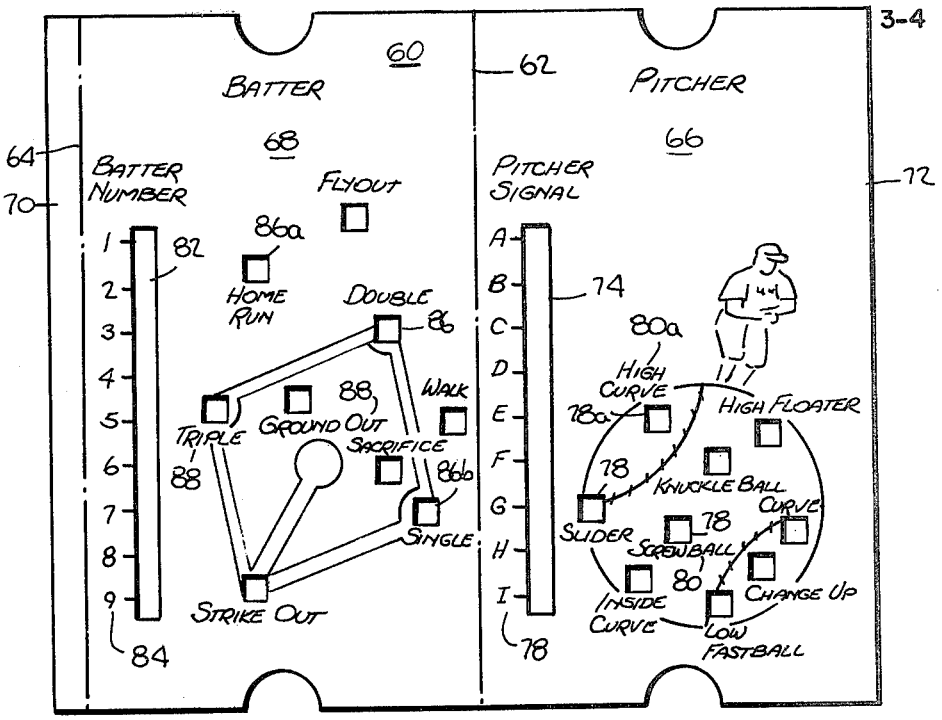
FIG. 6 is a view of a blank from which an envelope utilized in an alternative embodiment of the present invention is formed.
Figure 7:
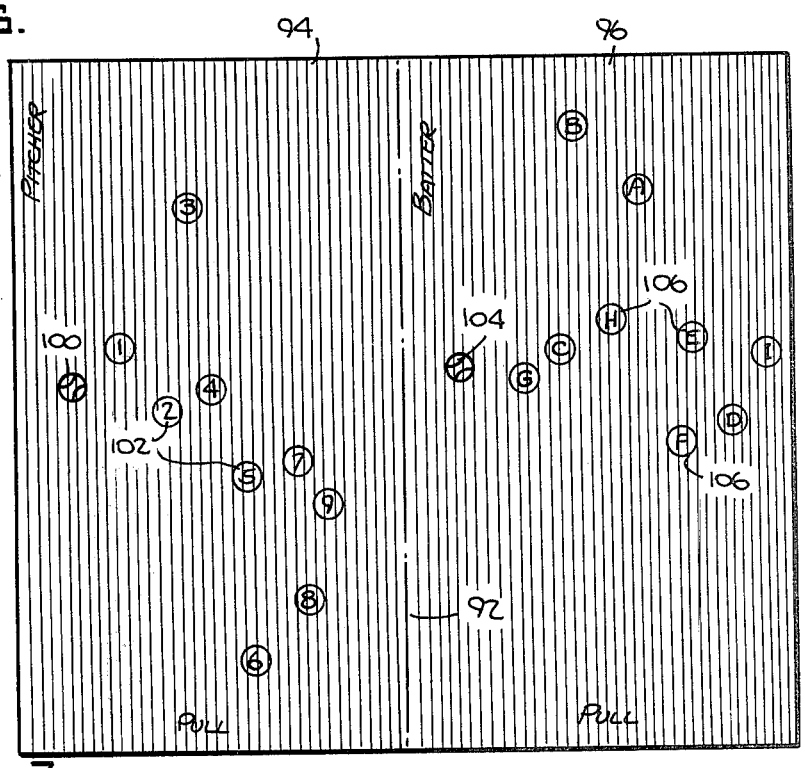
FIG. 7 is a view of a blank from which the slide utilized in the alternative embodiment is formed.

An alternative embodiment of the present invention is shown in FIGS. 6 through 9. There is shown in FIG. 6 a blank 60 which is divided by score lines 62 and 64 into a first face 66 a second face 68 and a flap 70. To form an envelope 71, the blank is folded so that the flap 70 is superimposed upon the edge 72 of the second face 68. The first face 66 is provided with window means which may be in the form of a longitudinal window 74 having a series of indicia, i.e., letters 78 printed adjacent thereto. Instead of the first face 66 having a single window appearing adjacent the longitudinal window 74 as is the case in the first embodiment, the first face 66 is provided with a multiplicity of small windows 78 set at predetermined positions in the face as shown. Each of the windows 78 has a particular pitch designation 80 associated therewith imprinted on the face. For instance the window **78*a* has associated therewith the pitch designation 80*a*** "high curve".

The second face 68 is provided with a window means in the form of a longitudinal window 82 having a series of indicia, i.e., numbers 84 associated therewith. In lieu of a single window, there is provided a representation of a baseball diamond having a series of windows 86 therein. Each of the windows has associated therewith a particular play 88. For instance the window 86*a* has associated therewith the play "home run" and the window 86*b* has associated therewith the play "single".

Another blank 90 is divided by a score line 92 into a first side 94 and a second 96. The first side 94 and the the second side 96 are folded over along the score line 92 to form a slide 98 which can be received within the envelope 71 formed by folding the blank 60 as hereinabove described.

The first side 94 has positioned thereon a marker 100 as well as a series of numbers 102 in predetermined positions. The second side 98 has a marker 104 and a series of letters 106 printed at predetermined positions thereon. The slide is positioned within the envelope so that the first side 94 is directly beneath the first face 66 and the second side 96 is directly beneath the second face 68.

Figure 8:
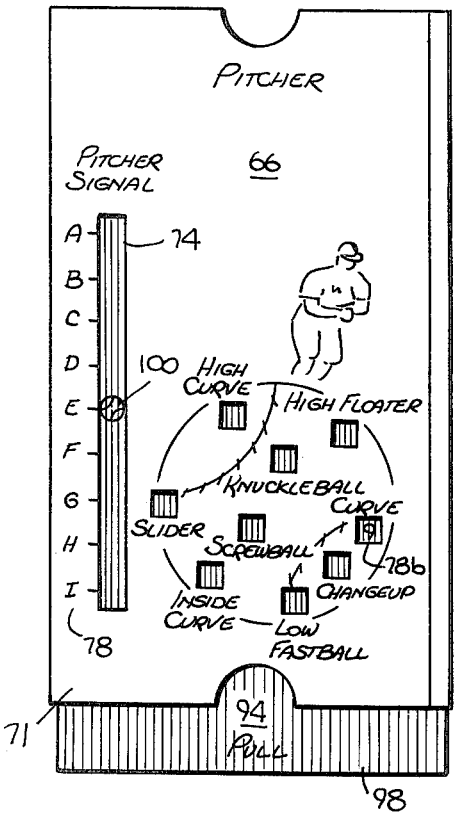
FIG. 8 is an assembled view of the game in accordance with the alternative embodiment of the present invention showing the face on which the pitcher's selection is made.

The manipulation of the game of this alternative embodiment is similar to that of the first embodiment discussed hereinabove. With reference to FIG. 8 the first player positions the marker means 100 appearing in the window 74 adjacent a particular letter in the series of letters 78. By way of example, the marker means 100 is shown adjacent the letter "E". By so doing, one of the numbers in the series 102 appears within one of the windows 78. By positioning the marker means 100 adjacent the letter "E" the number "9" appears in the window 78*b* identified as a "curve". The number "9" is an instruction to the second player to position the marker means 104 in the window 82 so that it is adjacent the number "9". This results in a letter in the series of letters 106 appearing in one of the windows 86. In this instance the letter "C" appears in window 86*c* marked "strike out". The second player incurs one out and the first player is instructed to position the marker means 100 adjacent the letter "C". Play continues in the same manner as in the embodiment illustrated in FIGS. 1 through 5.

Figure 9:
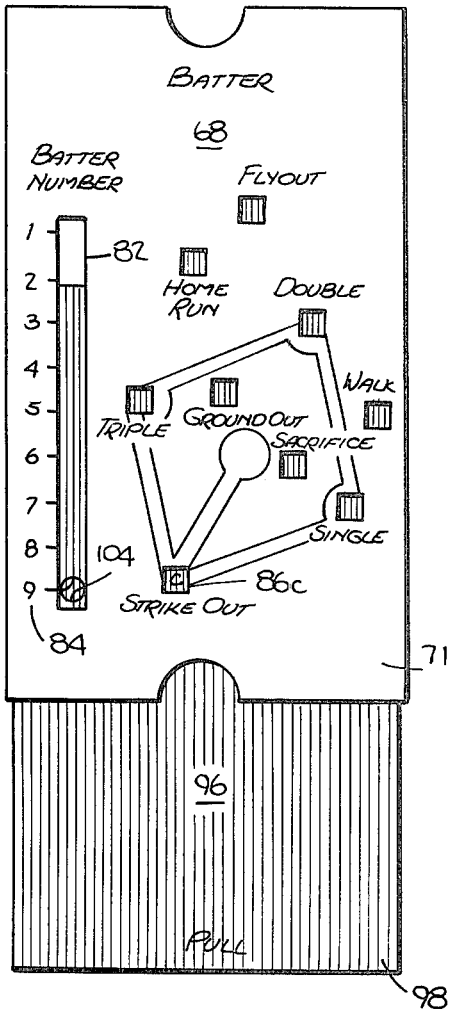
FIG. 9 is a view of the device in accordance with the alternative embodiment of the present invention from its reverse or batter's face.

As can be seen in FIG. 9, the series of windows 86 are dispersed throughout the representation of the baseball diamond and the follow up action to the pitcher's pitch appears in a particular window in the baseball diamond. If there is a strike out, the result appears in a window at home plate. If there is a home run, the result appears in a window so marked in deep left field. Other resultant hits and outs appear in different windows throughout the diamond. This may create in the player's imagination the impression that the baseball is actually being pitched or hit.

It can be seen in the embodiments described hereinabove, that the manner in which the game is played is quite simple. The first player at the beginning of each inning or game can exercise discretion as to where the marker is to be placed on his side of the game. After that step has been taken, the rest of the action for that inning or game is predetermined by the instructions appearing in the windows in the envelope. While such a game reduces the degree of skill and suspense associated with the game of baseball, it serves to give younger children a sense of the game as well as developing their skill of recall. Since all but the first step is predetermined, a youngster may, unwittingly, develop his abilities to memorize and recall facts.

It should be noted that the construction of the game described herein is such that different slides can be provided bearing other combinations of pitches and plays to add variety and a longer life to the game. In addition, while the particular sets of indicia 27, 54 78 and 106, and 31, 48, 84 and 102, are described as letters and numbers respectively, it will be understood that they could be reversed without detracting from the essence of the invention.

Furthermore, as noted hereinabove, the concept of the present invention is readily applicable to other sports such as football and soccer, and will also find application in playing card games, educational games, and sweepstakes.

Moreover, when two or more people are playing a game, each person may be provided with his or her own envelope and slide device. In this situation, the first player moves the slide in his device to place the marker means adjacent a particular indicium on the first face. The second player then follows the instructions appearing in the first face of the first player's device and moves the slide in his device to place the marker means thereon adjacent the particular indicium prescribed on the second face of his device. Play continues as detailed above, however, each player uses his or her own device.

In addition, while the devices described above are of an envelope and slide construction, the principles of the present invention may also be incorporated in a device in which the slide is replaced by a wheel rotatably retained within the envelope as in some types of circular or wheel calculators known in the art.

It can be seen that the objects of the present invention, namely to provide a simple game have been accomplished by constructing an envelope from a blank that is divided into a first face and a second face. The faces are provided with window means to reveal selectively, information contained on a slide moveably retained in the envelope. The first face has a first window means with a series of indicia associated therewith. Also in the first face is a second window means. Similarly the second face is provided with a window means having indicia associated therewith as well as fourth window means.

The slider has first and second sides which lie immediately beneath the first and second faces, respectively, of the envelope. The first side has a marker means thereon and a first set of instruction indicia. The second side similarly has a marker means thereon as well as a second set of instruction indicia.

To use the game, the marker means appearing in the first window means is positioned adjacent any one of the indicia associated therewith. This results in an instruction appearing in the second window means to position the marker means appearing in the third window means of the same or another envelope adjacent the indicium revealed in the second window means. By doing so, information is revealed in the fourth window means which not only signifies a resultant action but also provides instructions to position the marker appearing in the first window means adjacent another indicium included in the information revealed.

While particular embodiments of this invention have been shown and described, it will be obvious to those skilled in the art that various other changes and modifications may be made without departing from this invention in its broader aspects, and it is, therefore, aimed in the appended claims to cover all such changes and modifications as fall within the true spirit and scope of this invention.

What is claimed is:

1. A game comprising:

(a) an envelope provided with a first face having window means therein and a second face having window means therein;

(b) sets of indicia in cooperative relation to said window means on said first and second faces;

(c) a support means mounted within said envelope provided with sets of indicia including marker means visible within said window means on said first and second faces;

(d) said support means moveable to one position wherein said marker means appears in said window means in said first face adjacent an indicium associated with said window means to reveal an indicium in said window means in said first face; and (e) said support means moveable to another position wherein said marker means in said window means in said second face is positioned adjacent the indicium associated with said window means corresponding to the indicium appearing in said window means in said first face thereby revealing in said window means in said second face an action as well as an indicium to which said marker in said window means in said first face is to be moved.

2. The game in accordance with claim 1 wherein said window means in said first face includes a first window means and a second window means, and said window means in said second face includes a third window means and a fourth window means, said marker means being visible in said first and said third window means, and said indicia are revealed in said second and said fourth window means.

3. The game in accordance with claim 2 wherein said first window means is oriented longitudinally within said first face.

4. The game in accordance with claim 2 wherein said third window means is oriented longitudinally within said second face.

5. The game in accordance with claim 2 wherein said indicia associated with said first window means and said fourth window means are letters and said indicia associated with said second and third window means are numbers.

6. The game in accordance with claim 2 wherein said game is a baseball game, said indicium in said second window means includes a type of pitch and said indicium in said fourth window means includes a resultant play in the game of baseball.

7. The game in accordance with claim 6 wherein said second face bears the representation of a baseball diamond and said fourth window means is a series of openings in said face at various locations in said baseball diamond, said indicium in said fourth window means appearing at an appropriate location in said baseball diamond.

8. The game in accordance with claim 1 wherein said envelope and said support means are made of a light weight flexible material.

9. A game including, in combination:

(a) at least two envelopes, each envelope provided with a first face having window means therein and a second face having window means therein;

(b) sets of indicia in cooperative relation to said window means on said first and second faces;

(c) a support means mounted within each of said envelopes provided with sets of indicia visible within said window means in said first and second faces;

(d) said support means moveable within one of said envelopes to one position wherein said marker means appears in said window means in said first face adjacent an indicium associated with said window means to reveal an indicium in said window means in said first face; and (e) said support means moveable within another of said envelopes to a position wherein said marker means in said window means in said second face of said another envelope is positioned adjacent the indicium on said another envelope associated with said window means corresponding to the indicium appearing in said window means in said first face of said one envelope thereby revealing in said window means in said second face of said another envelope an action as well as an indicium to which said marker in said window means in said first face of said one envelope is to be moved.

10. The combination in accordance with claim 9 wherein said window means in said first faces include a first window means and a second window means, and said window means in said second faces include a third window means and a fourth window means, said marker means being visible in said first and said third window means, and said indicia being revealed in said second and said fourth window means.

11. The combination in accordance with claim 10 wherein said first window means are oriented longitudinally within said first faces.

12. The combination in accordance with claim 10 wherein said third window means are oriented longitudinally within said second faces.

13. The combination in accordance with claim 10 wherein said indicia associated with said first window means and said fourth window means are letters and said indicia associated with said second and third window means are numbers.

14. The combination in accordance with claim 10 wherein said game is a baseball game, said indicium in said second window means includes a type of pitch and said indicium in said fourth window means includes a resultant play in the game of baseball.

15. The combination in accordance with claim 14 wherein said second faces bear the representation of a baseball diamond and said fourth window means is a series of openings in said faces at various locations in said baseball diamond, said indicia in said fourth window means appearing at an appropriate location in said baseball diamond.

16. The combination in accordance with claim 9 wherein said envelopes and said support means are made of a light weight flexible material.

* * * * *